United States Patent [19]

Magadini

[11] Patent Number: 4,549,713

[45] Date of Patent: Oct. 29, 1985

[54] VERTICALLY ADJUSTABLE HANGERS FOR PICTURES, AND THE LIKE

[76] Inventor: Charles R. Magadini, 6024 N. 20th St., Phoenix, Ariz. 85016

[21] Appl. No.: 546,477

[22] Filed: Oct. 28, 1983

[51] Int. Cl.[4] ..... A47G 1/24

[52] U.S. Cl. ..... 248/495; 248/125

[58] Field of Search ..... 248/475.1, 476, 489, 248/493, 495, 215, 214, 297.5, 125; 40/617

[56] References Cited

U.S. PATENT DOCUMENTS

| | | | |
|---|---|---|---|
| 280,639 | 7/1883 | Lipe | 248/297.5 X |
| 1,196,936 | 9/1916 | Elsass et al. | 248/495 |
| 1,226,019 | 5/1917 | Schley | 248/495 |
| 1,285,500 | 11/1918 | Walters et al. | 248/297.5 X |
| 1,432,206 | 10/1922 | Poole, Jr. . | |
| 2,943,831 | 7/1960 | Goss | 248/495 |
| 3,208,701 | 9/1965 | Erickson | 248/27.8 |
| 3,285,549 | 11/1966 | Cook | 248/495 |

FOREIGN PATENT DOCUMENTS

| | | | |
|---|---|---|---|
| 48001 | 5/1911 | Austria | 248/495 |
| 513903 | 9/1952 | Belgium | 248/297.5 |

*Primary Examiner*—J. Franklin Foss

*Attorney, Agent, or Firm*—Laurence R. Brown

[57] ABSTRACT

A system of hanging objects and adjusting their vertical position provides verically disposed rods upon which spring biased hanger straps are locked in place against downward vertical movement. Thus, in a picture gallery or the like, frequent manual adjustments and alignments may be made by simply manually moving the hanger straps vertically after overcoming the spring bias. The straps are simply L or J shaped metal straps with a hole in a positioning leg passing over a slightly smaller rod and a parallel strap spring affixed thereto extending over the hole to deflect the spring when on the rod for locking the strap vertically in place by eccentric action of the aperture against the rod until the spring bias is manually overcome for adjustment of the vertical position. The strap has a hanger portion extending downwardly so that the weight of an object, such as a picture mounted thereon more tightly locks the hanger in place.

6 Claims, 4 Drawing Figures

VERTICALLY ADJUSTABLE HANGERS FOR PICTURES, AND THE LIKE

TECHNICAL FIELD

This invention relates to adjustable hangers, and more particularly it relates to vertically adjustable hangers mounted on rods for positioning pictures and the like.

BACKGROUND ART

In picture galleries there is a need for hanging pictures of various sizes and in various combinations, and the pictures frequently are changed, thus requiring adjustable mounting means.

It is desirable therefore that ease of adjustment be coupled with secure and positive mounting means that will prevent the picture from shifting position by tilting, slipping or dropping. Also, it is important to provide ease in mounting without tediously replacing strings, bolts or by preparing the picture to mate with a particular hanger or hanger position. After placement it is particularly important to slightly adjust a hanger to align or level a picture with minimal effort without disturbance to the strength of the support.

These same features are also important in hanging other objects such as tools, clothes, shelves, etc. Thus a universally adapable adjustable hanger assembly is desired for changing the position of hangers simply at will without disturbing the strength and stability of the hanger in supporting objects that may be heavy.

DISCLOSURE OF THE INVENTION

This invention therefore provides simple effective vertically adjustable hangers adapted to ride upon a vertically disposed rod that can be movably positioned on a horizontally disposed rod for horizontal adjustment thereby permitting both horizontal and vertical positioning adjustments for mounting pictures, mirrors, clocks and the like on walls.

Vertical adjustments are made simply by sliding the hanger to the desired position on the rod, yet the weight of an object hanging on the rod will lock the hanger firmly and immovably in place. Small adjustments for levelling a picture or matching it to align with a vertical position can be made simply without any structural change. The invention is ideally suited for picture gallery displays, commercial displays and other applications where frequent changes are desired in the vertical positioning of hangers.

The selectively positionable hanger itself is simply a metal strip bent generally into L or J shape with a hole in the end of the longer mounting leg from which the hook portion is bent outwardly for passing over a slightly smaller vertical rod preferably square, and having affixed thereto parallel to the mounting leg a sheet spring, preferably of neoprene. This spring, with the hanger positioned on the rod forces the hook portion downwardly to receive a picture or other object, and in doing so causes the hole to bite into the rod and lock eccentrically against downward movement, as further secured by weight of a hung object. However, with slight manual upward pressure on the hook end, the spring pressure is overcome to move the mounting leg more horizontal to let the hole slip over the rod upwardly or downwardly to a new locking position attained simply by release of the hook end to relock.

A system of rods can move horizontally and multiple hangers on each rod can permit a flexible wall or panel array for mounting a variety of objects as in a picture gallery, a commercial display of featured products, etc.

Other objects, features and advantages of the invention will be found throughout the following description, the drawings and the claims.

THE PREFERRED EMBODIMENT

Figure 2:
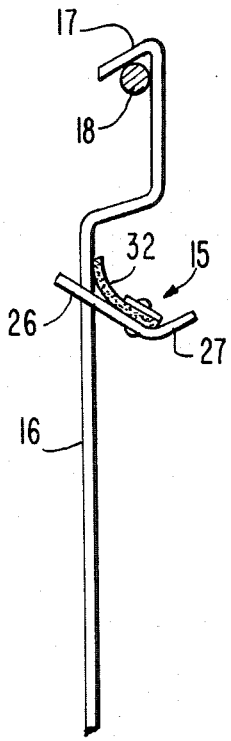
FIG. 2 is an end view of a mounting system provided by this invention wherein the hangers are vertically positionable on rods hanging downwardly from a plurality of horizontally positionable locations.
Figure 4:
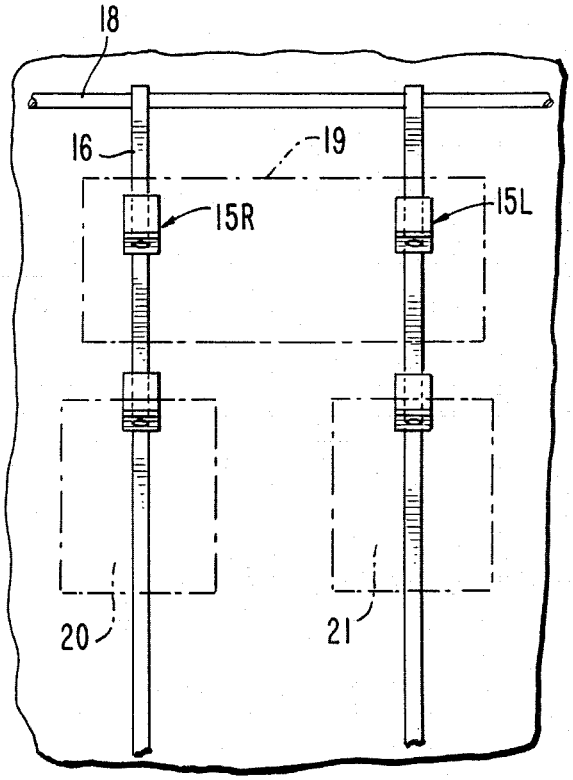
FIG. 4 is an elevation view sketch of a panel or wall upon which the hanging means of this invention are mounted for adjustably positioning objects such as shown in phantom.

It may be seen from the drawing that a hanger bracket assembly afforded by this invention has a hanger member 15 vertically positionable upon a vertically oriented rod 16, preferably square in cross section. In FIGS. 2 and 4 it may be seen that the vertically disposed rods 16 may be disposed by a hook 17 or other suitable structure over a horizontally disposed rod 18 permitting lateral movement of the hanger members. Thus, a picture or mirror 19 may be hung on two hanger members 15R and 15L suitably disposed in selectable horizontal and vertical positions. After mounting the picture 19 may be levelled or aligned parallel to other pictures, etc. 20, 21 by slight vertical movement of the hangers 15R and 15L as needed.

Figure 1:
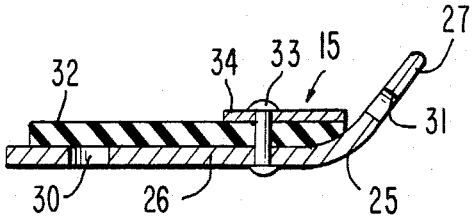
FIG. 1 is a side view in section of a hanger provided by this invention.
Figure 3:
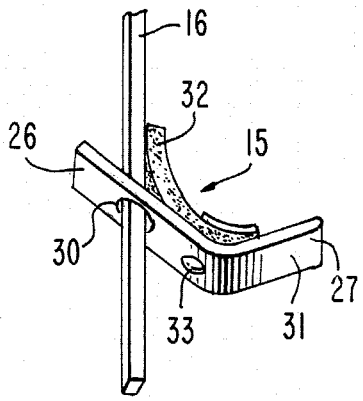
FIG. 3 is a segmental view in perspective of a hanger positioned on a square rod.

The construction details of the hanger 15 and its mode of operation may best be understood by reference to FIGS. 1 and 3. Thus, a rigid strap member 25, preferably of metal is formed with a positioning leg portion 26 and an integral hanger portion 27 bent therefrom into a generally L or J shaped member. The positioning leg 26 has located therein near the end of the strap an aperture 30 of a diameter that is slightly larger than the outside dimensions of the square rod 16 to move freely thereon when the positioning leg is perpendicular to the shaft. A hanger aperture 31 is optional depending on the nature of the object that will be hung.

Parallel to the positioning leg 26 and extending at least partly over the aperture 30 is a sheet spring member 32 affixed to the strap member 25 near the hanger end by means of a rivet 33 or other suitable fastening means. Preferably this spring sheet is neoprene since it cannot exceed its elastic limit in normal use of the hanger. A metal or tough plastic reinforcement plate 34 may be positioned at the hanger end to prevent damage to the neoprene sheet.

As seen from FIGS. 2 and 3, the hanger member aperture 30 is passed over the square, preferably metal, rod 16 to engage the sheet spring 32 against one flat face of the rod and thereby hold the hook in place in a specific radially oriented position on one face of the rod. While a round rod would otherwise work, a flat faced rod is preferred for this feature.

Also it is seen that the spring sheet 32 disposes the hanger end 27 downwardly to form an object receiving hook for hanging at a vertical position along the rod 16. When the positioning leg 26 is rotated against the spring bias to a position more perpendicular to the rod, then the hanger assembly 15 can be moved up and down the rod. However, as seen best from FIG. 3, the spring 32 orients the hanger strap with positioning leg 26 at an acute angle to the rod 16, and thus making the aperture 30 eccentrically bite into the corners of the square rod 16 and lock the hanger in place to prevent any downward movement. Also the locking strength is increased when an object such as a picture is hung on the hanging hook portion 27 because of the weight of such object.

The locking action is enhanced by use of a metal strap and a metal square rod by the biting action of the corners and edges of the metal. The locking action per se is similar to that shown in the O. C. Poole, Jr., U.S. Pat. No. 1,432,206—Oct. 17, 1922.

Typically the rod 16 is about 4 mm per side of steel, the aperture 30 is 7 mm in diameter, the strap is 12 mm wide and 1.5 mm thick of steel about 5 cm long. The neoprene sheet spring is about 6 mm thick.

While firm locking results from the hanger provided, nevertheless simply and manually the hanger strap can be slightly rotated (counter clockwise as shown) against the spring bias to permit aperture 30 to slide either upwardly or downwardly on the rod 16 at any desired position. It is clear therefore that a strong but easily positionable hanger assembly is provided by this invention that is particularly adapted to circumstances such as commercial displays for frequent repositioning of the hangers. FIG. 4 illustrates the system flexibility for use in a picture gallery as a typical exemplary application providing flexibility for arranging various sizes and combinations of hanging objects.

Clearly the state of the art has been advanced by this invention and those novel features believed directed toward the nature and spirit of the invention are defined with particularity in the following claims.

I claim:

1. A vertically positionable hanger bracket assembly for holding an object in a vertical position along a vertically oriented rod, comprising in combination, a rigid hanger strap formed as a substantially planar sheet having a positioning leg portion with a rod receiving aperture therethrough and an integral hanger portion extending therefrom at an angle to provide a hanging hook for receiving an object thereon, said rod receiving aperture being of a size to cooperatively engage a rod of a slightly smaller outer dimension so that the strap may be oriented with the hanger portion lowermost to cause the aperture to eccentrically engage and lock the hanger strap against the rod to prevent downward vertical movement when the hanger portion is held downwardly, such as by a weight, and a sheet spring locking member disposed generally parallel to the positioning leg portion and fastened thereto to extend from a position near the hanger portion toward the aperture, said spring being disposed at least partly over said aperture so that when the aperture is positioned along the rod the spring is deflected and rides on the rod in such manner that the hanger portion extends downwardly and is locked in place by eccentric engagement of the aperture against the rod, as biased into the locked position by the spring to prevent downward movement of the hanger strap along the rod, and thereby permits the hanger portion to be manually forced upwardly against the spring bias to unlock the eccentric aperture-rod engagement and permit the hanger to be vertically moved along the rod to a desired new locking position.

2. The hanger assembly defined in claim 1 wherein the spring comprises a neoprene sheet.

3. The hanger assembly defined in claim 1 with the hanger strap mounted on a rod.

4. The hanger assembly as defined in claim 3 wherein the rod is substantially square in cross section.

5. The hanger assembly as defined in claim 4 wherein the rod and rigid strap are metal.

6. A system for hanging objects in predetermined manually selected vertical positions comprising in combination, a set of rods disposed in a geometric pattern, a set of hooks movably disposed on said rods for changing the geometric pattern and presenting a portion of the hooks in said set for holding and positioning an object at variable positions on said pattern of rods, hook structure for those hooks holding the object including mounting means for mounting on said rods comprising a rigid strap having a substantially flat planar portion engaging aperture riding snugly on the rod for positioning therealong with the flat planar portion substantially perpendicular to the rods, and locking means comprising a sheet spring plate disposed substantially parallel to the planar portion to engage the rods when extending through the aperture thereby to flex the hook strap by spring bias causing the hook structure to extend downwardly while biasing the aperture in an eccentric locking engagement with the rods to prevent downward movement of the hooks on the rods.

* * * * *